US011668089B2

(12) United States Patent
Chapman

(10) Patent No.: US 11,668,089 B2
(45) Date of Patent: Jun. 6, 2023

(54) CONCRETE FORM ASSEMBLY

(71) Applicant: Logix Brands Ltd., Port Hope (CA)

(72) Inventor: Kurtis Chapman, Toronto (CA)

(73) Assignee: Logix Brands Ltd, Port Hope (CA)

( * ) Notice: Subject to any disclaimer, the term of this patent is extended or adjusted under 35 U.S.C. 154(b) by 150 days.

(21) Appl. No.: 17/188,618

(22) Filed: Mar. 1, 2021

(65) Prior Publication Data

US 2022/0275656 A1 Sep. 1, 2022

(51) Int. Cl.
*E04B 2/86* (2006.01)
*E04G 11/08* (2006.01)

(52) U.S. Cl.
CPC ..... *E04B 2/8617* (2013.01); *E04B 2/8635* (2013.01); *E04G 11/087* (2013.01)

(58) Field of Classification Search
CPC ..... E04B 2/86; E04B 2/8611; E04B 2/8617; E04B 2/8635; E04B 2/8652
USPC ..... 52/426
See application file for complete search history.

(56) References Cited

U.S. PATENT DOCUMENTS 5,409,193 A 4/1995 Baxter
5,744,076 A 4/1998 Baxter
6,308,484 B1 10/2001 Severino
6,314,697 B1 11/2001 James, Jr.
6,318,040 B1 11/2001 James, Jr.
6,363,683 B1 * 4/2002 Moore, Jr. ..... E04B 2/8641 52/562
6,668,503 B2 * 12/2003 Beliveau ..... E04B 2/8635 52/426
6,792,729 B2 * 9/2004 Beliveau ..... E04B 2/8635 52/441
6,945,506 B2 9/2005 Long, Sr.
7,415,804 B2 8/2008 Coombs et al.
D614,941 S 5/2010 Murphy
7,810,293 B2 10/2010 Gibbar et al.
7,818,935 B2 10/2010 Velickovie
7,827,752 B2 * 11/2010 Scherrer ..... E04B 2/8641 52/426
8,037,652 B2 * 10/2011 Marshall ..... E04B 2/8635 52/564
8,096,094 B2 1/2012 Mees
9,033,303 B2 5/2015 McDonagh
9,038,338 B2 5/2015 Rice
9,074,379 B2 7/2015 Ciuperca
10,167,633 B2 1/2019 Foderberg et al.
(Continued)

FOREIGN PATENT DOCUMENTS

CA 2801735 7/2013
EP 2010734 7/2009
(Continued)

*Primary Examiner* — Michael Safavi
(74) *Attorney, Agent, or Firm* — Brad J. Thorson; DeWitt LLP

(57) ABSTRACT

Concrete form assemblies having insulating foam panels are created using locking members embedded within the insulating foam panels and ties each having a pair of side rails for coupling two insulating foam panels together at a predetermined distance apart, the locking members and side rails being adapted so that either side rail can be coupled to either locking member and either of the ends of the rails and locking members can be toward the top or bottom of the assembly when the rails are coupled to the locking members.

18 Claims, 15 Drawing Sheets

(56) References Cited

U.S. PATENT DOCUMENTS

| | | | | |
|---|---|---|---|---|
| 2005/0028466 | A1* | 2/2005 | Titishov | E04B 2/8617 52/474 |
| 2005/0155306 | A1 | 7/2005 | Childres | |
| 2007/0209310 | A1 | 9/2007 | Papke | |
| 2012/0096797 | A1* | 4/2012 | Garrett | E04B 2/34 52/426 |
| 2015/0089894 | A1 | 4/2015 | Ryan | |
| 2018/0112400 | A1 | 4/2018 | Dajnko | |
| 2019/0093348 | A1 | 3/2019 | Robak | |

FOREIGN PATENT DOCUMENTS

| | | | | |
|---|---|---|---|---|
| GB | 2458317 | A * | 9/2009 | E04B 2/8617 |
| WO | WO-9523899 | A1 * | 9/1995 | E04B 2/8617 |
| WO | 2010047919 | | 4/2010 | |
| WO | 2015059594 | | 4/2015 | |

* cited by examiner

CONCRETE FORM ASSEMBLY

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

I. Field of the Invention

The present invention relates generally to concrete forms. More specifically, the present invention relates to a locking and tie system for forming insulated forms used in the manufacture of concrete walls and the like.

II. Related Art

Many buildings are constructed on concrete foundation walls. Sometimes these concrete foundation walls are formed of precast concrete blocks. At other times, these concrete foundation walls are formed by assembling forms and then pouring concrete into the assembled forms.

Assembling such forms is often a laborious task involving the use of expensive materials such as metal or wood. Forms made of metal are very heavy and extremely labor-intensive to assemble and remove after pouring the concrete.

More recently, insulated concrete forms have been used. Insulated concrete forms are constructed of insulated panels, e.g., panels made of expanded polystyrene, which are connected in parallel using a series of rigid ties to form blocks. The blocks are then stacked or otherwise positioned to complete the form. Concrete is then poured between the panels.

Different sized ties may be employed to adjust the resulting thickness of the poured concrete wall. Even after the concrete has cured, the foam panels are typically left in place, rather than removed, to assist in insulating the building.

Significant problems exist with the insulated concrete forms presently available in the marketplace. Most are made with fixed webs and come to a job site as fully assembled blocks. These fully assembled blocks take up a lot of room and create inefficiencies for storage, shipping, and handling.

There are also problems with exiting concrete form systems that come to the job site unassembled (i.e., knock down insulated concrete forms). Existing knockdown insulated concrete forms take time to assemble on site, and the components do not lock into place properly. The components will bear more concrete and rebar weight only when oriented in a specified fashion, thus requiring the blocks themselves to be oriented in a specific manner. The components fail to stay properly assembled and fail to provide sufficient form strength. This is particularly true when they are cut in half, which can happen often to facilitate window and door opening placement.

The components of knockdown insulated concrete forms presently available in the marketplace are neither interchangeable nor reversable. Instead, they have a top and bottom and some have a left and a right orientation required for proper assembly. This creates inefficiency when assembling the forms.

Further, such systems result in inefficient use of materials, increased manufacturing costs, increased shipping costs, and increased space requirements for storage and transportation. Some require the blocks be assembled on the wall being built. This means the blocks cannot be pre-assembled elsewhere and carried as an assembled unit.

Thus, there exists a need for knockdown insulated concrete forms which ship flat, fill a truck well, are easy to store, easy to handle, easy to assemble at the job site, and are sturdy enough so they do not inadvertently come apart during assembly, installation of rebar or pouring of concrete into the form.

SUMMARY OF THE INVENTION

The present invention solves the foregoing problems by providing concrete form assemblies, each comprising a first locking member, a second locking member, and a tie. The ties have no top or bottom, left or right. Likewise, the locking members have no top or bottom. As such, the components ship flat, fill a truck well, are easy to store, easy to handle, and easy to assemble into sturdy blocks and then into an insulated concrete form at the job site. Such blocks may be cut in half to facilitate window and door opening placement. Such forms are also sufficiently sturdy to handle the forces normally encountered when installing rebar within the form and pouring concrete into the form.

Each of the locking members has an inner plate with an inside surface and an outside surface, an outer plate, and a plurality of struts extending between the outside surface of the inner plate and the outer plate. The struts are adapted to hold the inner plate and outer plate in spaced relation relative to each other.

A first row of teeth and a second row of teeth project from the inside surface of the inner plate of each of the locking members. The second row of teeth is spaced from the first row of teeth. Each tooth of the first row of teeth has an inner surface, and a recess between the inside surface of the inner plate and the inner surface of the tooth. This recess is open toward the second row of teeth. Likewise, each tooth of the second row of teeth has an inner surface, and a recess between the inside surface of the inner plate and the inner surface of the tooth. This recess is open toward the first row of teeth. Additionally, each row of teeth has a pair of end teeth. These end teeth include notches facing away from the other teeth of the row.

The first and second locking members are interchangeable, i.e., either can be attached to the left or right side of the tie. Also, the first and second locking members are reversable, i.e., either end of a locking member can face up or down.

The tie comprises a first rail and a second rail, and at least one bridging member extending between the first rail and the second rail holding the first rail and second rail a predetermined distance apart. Each of these rails is configured like an I-beam having an outer rail member, an inner rail member, a connecting member. Each rail also includes at least one locking tab at each end of the rail. As such, the tie is reversable both horizontally and vertically such that the tie has no predetermined top or bottom or left or right side.

The tie is adapted so that the first rail can be coupled to one of the locking members and the second rail can be coupled to the other of the locking members. Such a connection between a rail of the tie and either of the locking members is made by aligning the tie with the locking member so that the connecting member of the rail is between the first row of teeth and the second row of teeth of the locking member, the outer rail member of the tie is aligned with channels formed by the recesses in the teeth of the locking member, and the inner rail member of the tie is just inside of the inner surfaces of the teeth of the locking member. The tie and locking member are then slid together. As this occurs, the connecting member slides between the two rows of teeth, the outer rail member of that rail sides through and is captured within the recesses of the teeth of both the first and second rows of teeth of the locking member, and the inner rail member slides across and engages the inner surface of the teeth of both the first and second rows of teeth of the locking member. When the leading end of the rail is slid all the way across the locking member, the tabs engage the notches of the end teeth at both ends of the locking member preventing movement of the tie relative to the locking member. The tie can be attached to another locking member in this same way.

Significantly, the tie has no top, bottom, left or right orientation. This eases assembly. Likewise, neither locking member must be positioned on a specific end of the tie, and the locking members have no top or bottom.

The locking members are adapted to be embedded in the insulative foam material from which the panels are formed. In most cases these panels will be formed with the foam material filling the spaces between the struts and the outside surface of the inner plate and the outer plate. This serves to couple the locking member to the panels. Further, the panels have an inside panel surface defining a plane. The panel is formed to include a channel extending from this plane to the inner plate of the locking member. This channel is deep enough so that the teeth are substantially co-planar with the inside panel surface. This allows the panels to be prefabricated with the locking members fixed in place and easily stacked for transport and storage. Of course, the channel is wide enough so that the foam material does not interfere with coupling the tie to the locking member, as described above.

The tie is dimensioned to hold two connected insulated panels a predetermined distance apart. By way of example, and without limitation, this distance may be 4 inches, 6 inches, 8 inches, 10 inches or 12 inches apart. Likewise, the locking members and ties may be dimensioned to accommodate panels of different dimensions. By way of example, and without limitation, the panels may be 12 inches by 12 inches, or 16 inches by 16 inches.

Ideally each locking member and each tie is formed of a single piece of a suitable plastic material. The selected plastic material should allow the panels to be assembled into blocks using the locking members and ties. These blocks, once assembled, can be used in any direction with the same amount of strength regardless of orientation. The locking tabs on the two ends of the rails of the tie described above are two-way and allow the tie to be inserted in any direction. There is no predetermined top or bottom and there is no predetermined left or right side to the center tie.

Additionally, the notches in the end teeth of the locking members allow the locking tabs to resist downward pressure. As downward pressure is applied to the center tie, the locking tabs wedge in place providing sufficient strength to allow the assembly to hold rebar and resist the outward forces applied as concrete is poured into the form.

There are scenarios in which cutting a block of a form in half is desirable, such as to provide window and door openings. As such, the ties and locking members are scored or are otherwise designed to be easily separated into two or more pieces. When a block is cut in half horizontally one of the two bringing members resides in each of the two halves. As such, the half block will sit properly in position when the blocks are stacked, providing form support for the concrete pour, and fastening surfaces for the finishes after the wall is poured with concrete.

Once a block is assembled, the tie is locked in place with respect to the two locking members in all directions. As such, the now-assembled block can (1) be confidently handled as a unit, and (2) the now-assembled block can be also considered to have no left or right, top or bottom, once again increasing efficiency when placing the block to create the form. In particular, the ties of the blocks will bear the weight of concrete and rebar equally well, regardless of orientation.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
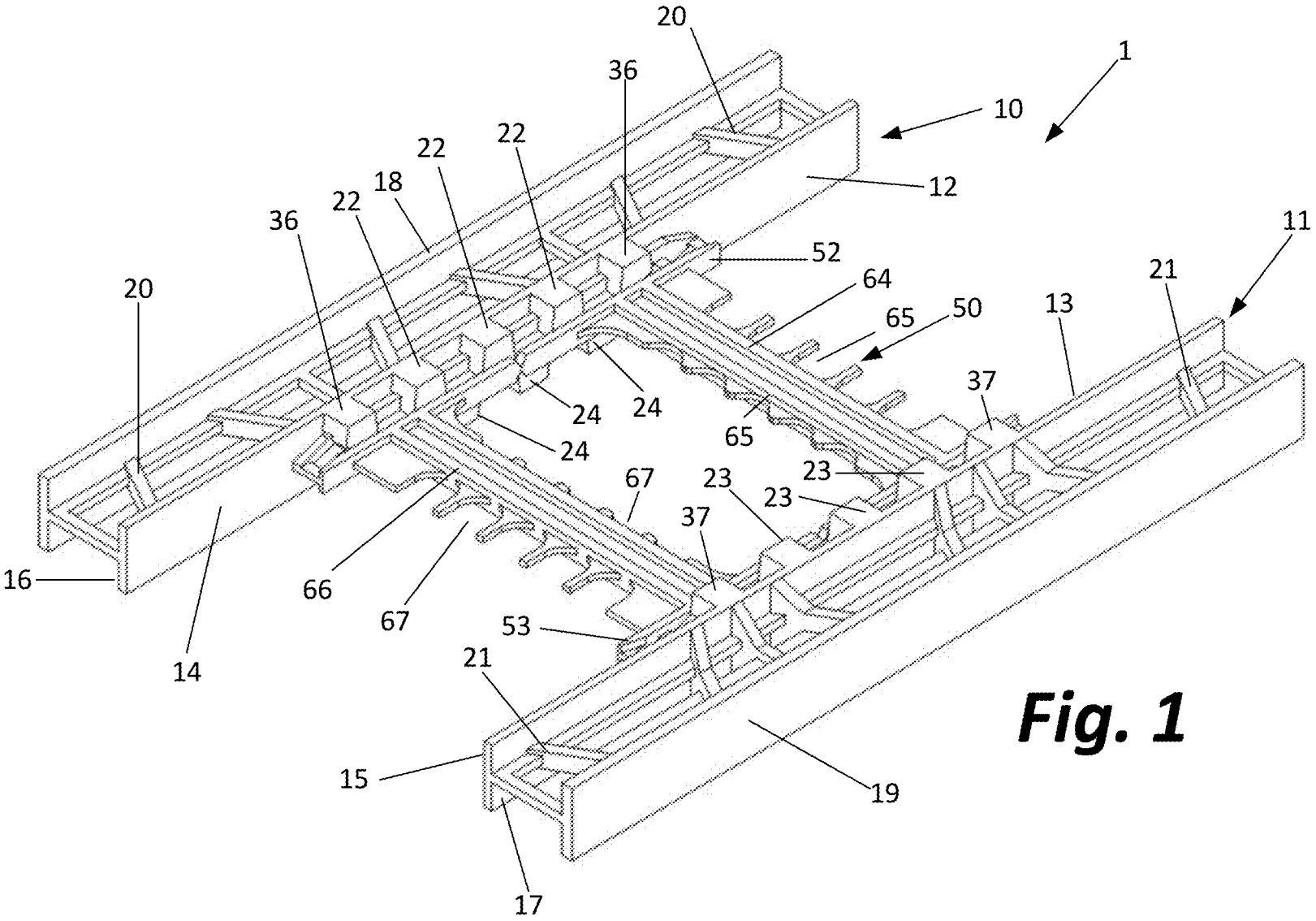
FIG. 1 is a perspective view of a tie and two locking members of a concrete form assembly, all made in accordance with the present invention and connected.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

FIGS. 1-15 show an insulated concrete form support assembly 1 comprising a first locking member 10, a second locking member 11, and a tie 50. The first locking member 10 and the second locking member 11 are constructed in an identical manner and are preferably each molded as a single piece from a suitable thermoplastic polymer such as recycled polypropylene. Other thermoplastic materials such as virgin polypropylene, polyethylene, polypropylene, polyvinyl chloride, acrylonitrile butadiene styrene, polycarbonate, or polyamide may be used without deviating from the invention. The tie 50 is also preferably molded as a single piece from such a thermoplastic polymer.

The locking members 10/11 have an inner plate 12/13. The inner plate 12/13 has an inside surface 14/15 and an outside surface 16/17. The locking members also have an outer plate 18/19. The inner plate 12/13 and the outer plate 18/19 are fixed together in a parallel spaced relation by a series of struts 20/21. More specifically, the struts 20/21 are coupled at one end to the outer plate 18/19 and at another end to the outside surface 16/17 of the inner plate 12/13. The struts 20/21, the outer plate 18/19 and the inner plate 12/13 combine to define a series of spaces 44/45.

Two rows of teeth project from the inside surface 14/15 of the inner plate 12/13. As shown in the drawings, inside surface 14 has a first row of teeth 22 and a second row of teeth 24 separated by a gap 26 while inside surface 15 has a first row of teeth 23 and a second row of teeth 25 separated by a gap 27.

Each of the teeth have certain features in common. All the teeth have an inner surface. More specifically, locking member 10 has a first row of teeth 22 having inner surfaces 28, and a second row of teeth 24 having inner surfaces 32. Likewise, locking member 11 has a first row of teeth 23 having inner surfaces 29 and a second row of teeth 25 having inner surfaces 33.

Figure 12:
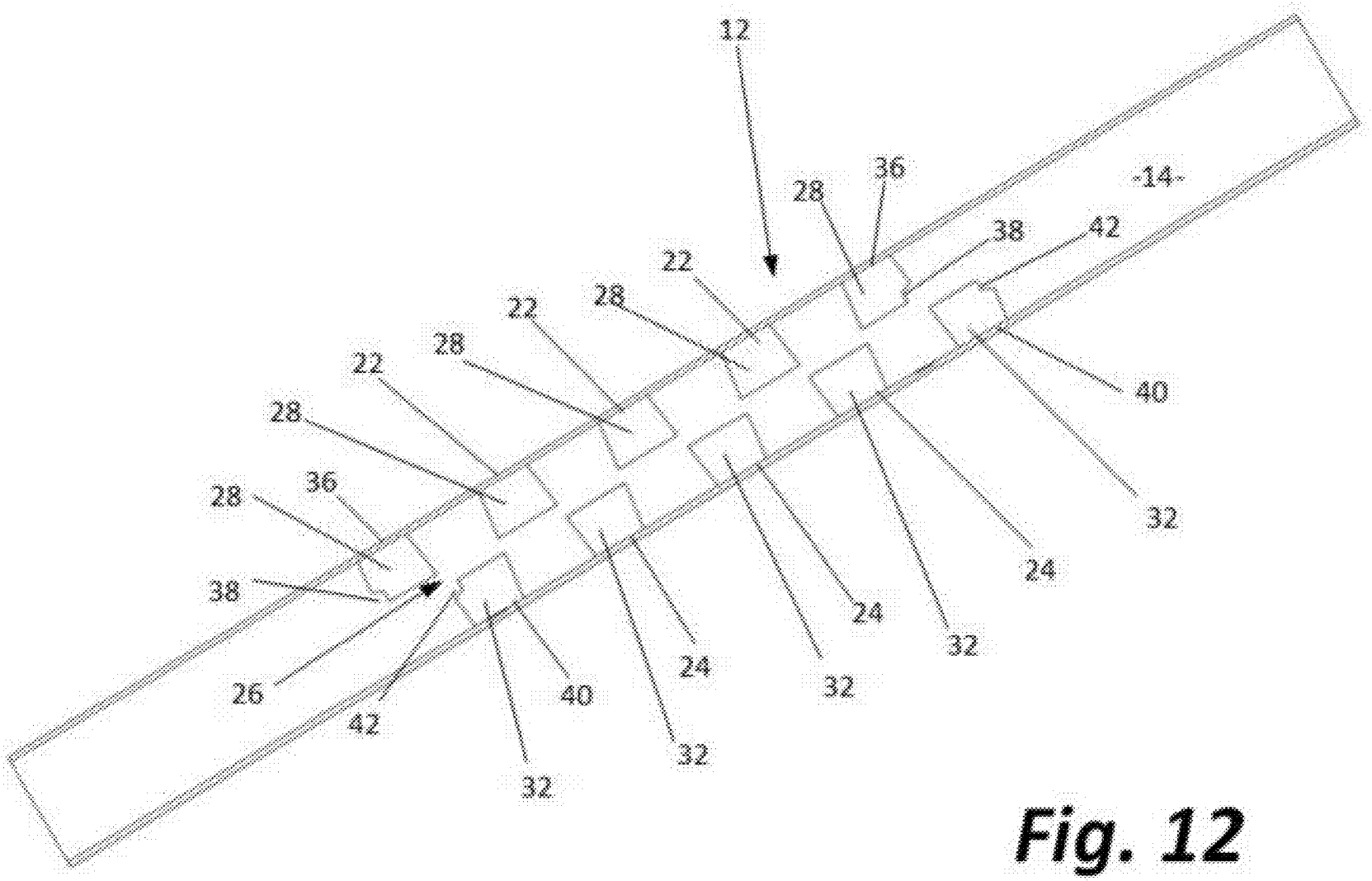
FIG. 12 is a side plan view of the locking member of FIG. 4.

Each tooth also includes a recess or cavity positioned between the inside surface of the inner plate and the inner surface of the tooth. More specifically, each tooth of first row 22 of the first locking member 10 has a recess 30 between the inside surface 14 of inner plate 12 and the inner surface 28 of the tooth, and each tooth of second row 24 of the first locking member 10 has a recess 34 between the inside surface 14 of the inner plate 12 and the inner surface 32 of the tooth. It is important to note that the recesses 30 in the teeth of the first row of teeth 22 are open toward the second row of teeth 24. Likewise, the recesses 34 in the teeth of the second row of teeth 24 are open toward the first row of teeth 22. Further, the teeth of the first row of teeth 22 are offset from the second row of teeth 24 as best shown in FIG. 12. In other words, the teeth of one row are aligned with spaces between the teeth of the other row.

Figure 13:
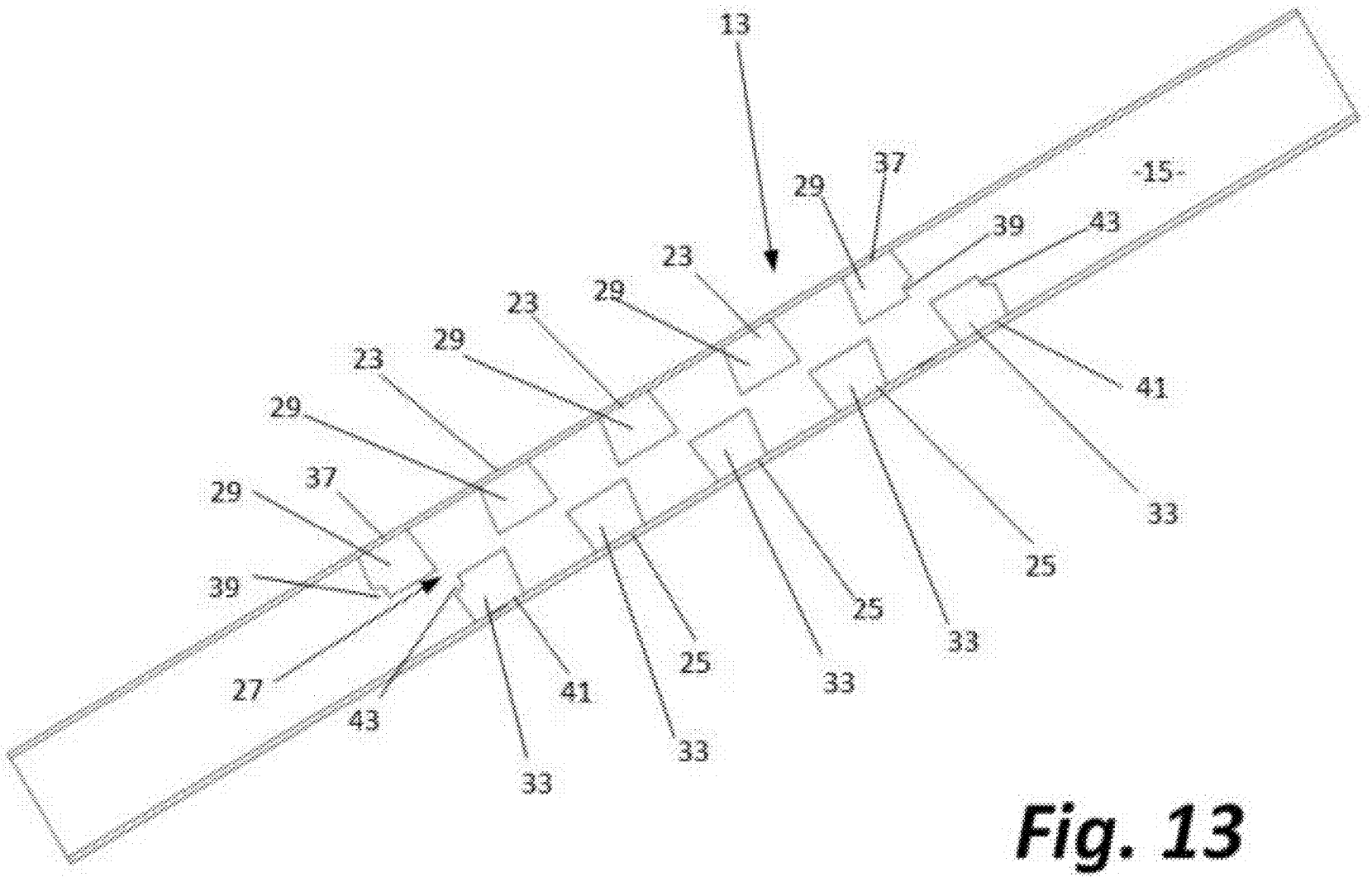
FIG. 13 is a side plan view of the locking member of FIG. 7.

As indicated above, the two locking members 10 and 11 are constructed in an identical fashion. As such, each tooth of first row 23 of the second locking member 11 has a recess 31 between the inside surface 15 of inner plate 13 and the inner surface 29 of the tooth, and each tooth of second row 25 of the second locking member 11 has a recess 35 between the inside surface 15 of the inner plate 13 and the inner surface 33 of the tooth. The recesses 31 in the teeth of the first row of teeth 23 are open toward the second row of teeth 25. Likewise, the recesses 35 in the teeth of the second row of teeth 25 are open toward the first row of teeth 23. Further, the teeth of the first row of teeth 22 are offset from the second row of teeth 25 as shown in FIG. 13.

Each of the rows of teeth have two end teeth, one at each end of the row. Each of the end teeth is notched. In row 22, the end teeth are labeled 36 and the notches in the end teeth 36 are labeled 38. In row 23, the end teeth are labeled 37 and the notches in the end teeth 37 are labeled 39. In row 24, the end teeth are labeled 40 and the notches in the end teeth 40 are labeled 42. In row 25, the end teeth are labeled 41 and the notches in the end teeth 41 are labeled 43. Other teeth may be notched as well without deviating from the invention. These notches in the end teeth extend into the tooth from the tooth's inner surface on the outside of the end tooth such that each notch in an end tooth faces away from the other teeth in the same row as the end tooth.

Sometimes it is advantageous to split a locking member 10/11 into two. As such, the locking members 10/11 may be scored, i.e., provided with an area of reduced thickness, to accommodate splitting the locking member in two. When this is the case, the four teeth (the two in each of the two rows on opposing sides of the score) immediately adjacent the scoring may be notched. These notches extend into the tooth from the tooth's inner surface and face toward the score.

Figure 2:
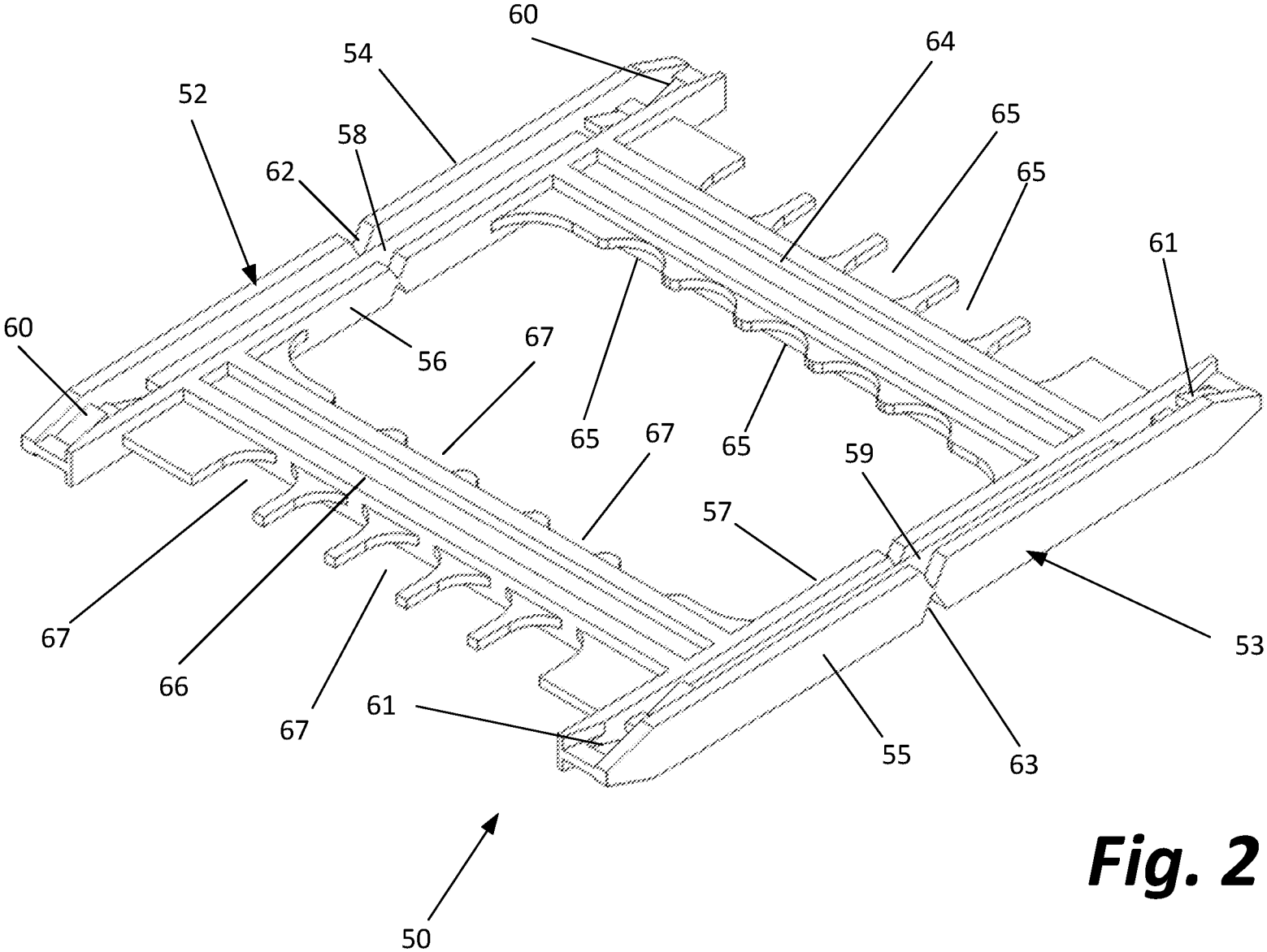
FIG. 2 is a perspective view of the tie of FIG. 1.
Figure 3:
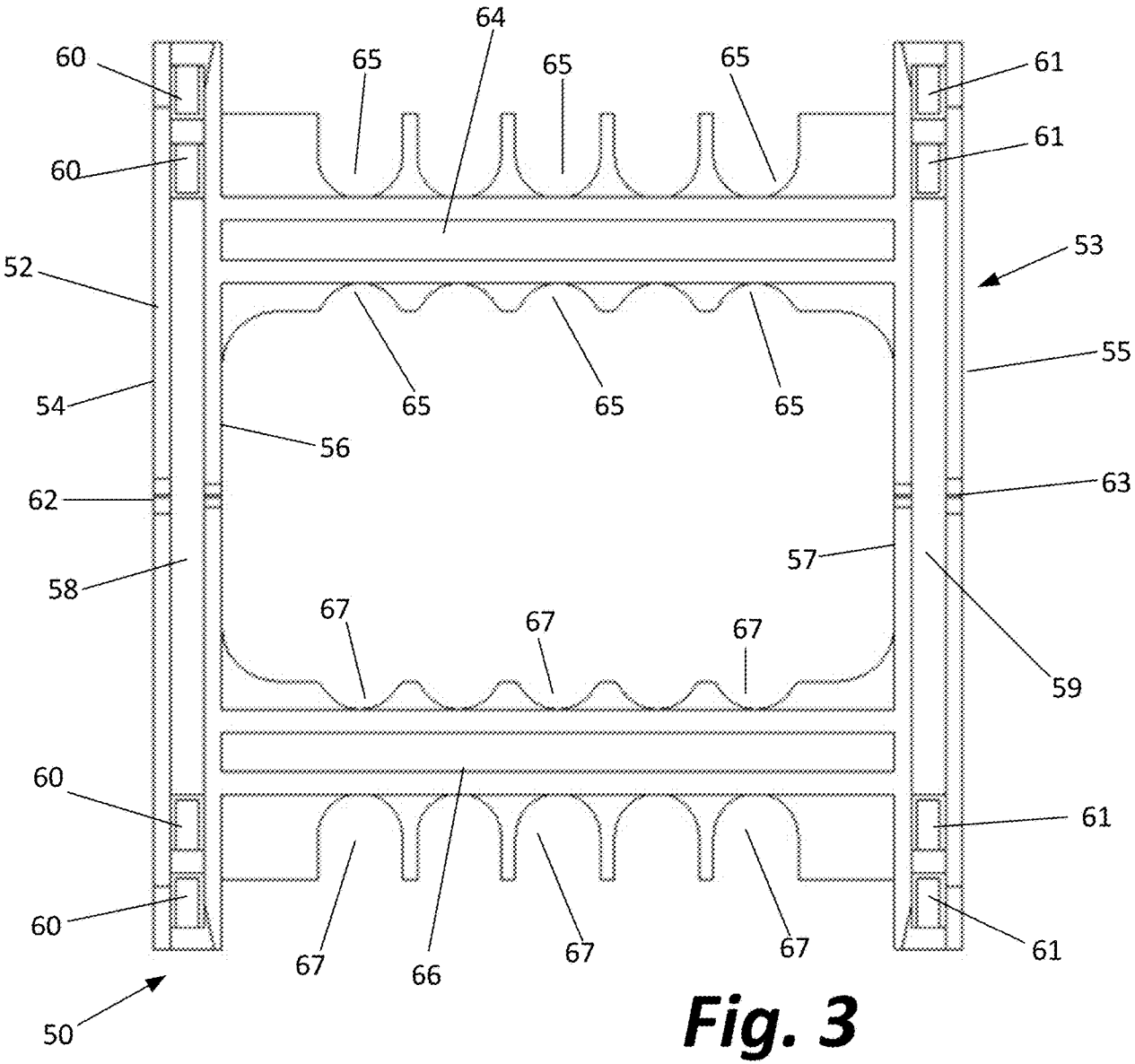
FIG. 3 is a front plan view of the tie of FIG. 1.
Figure 4:
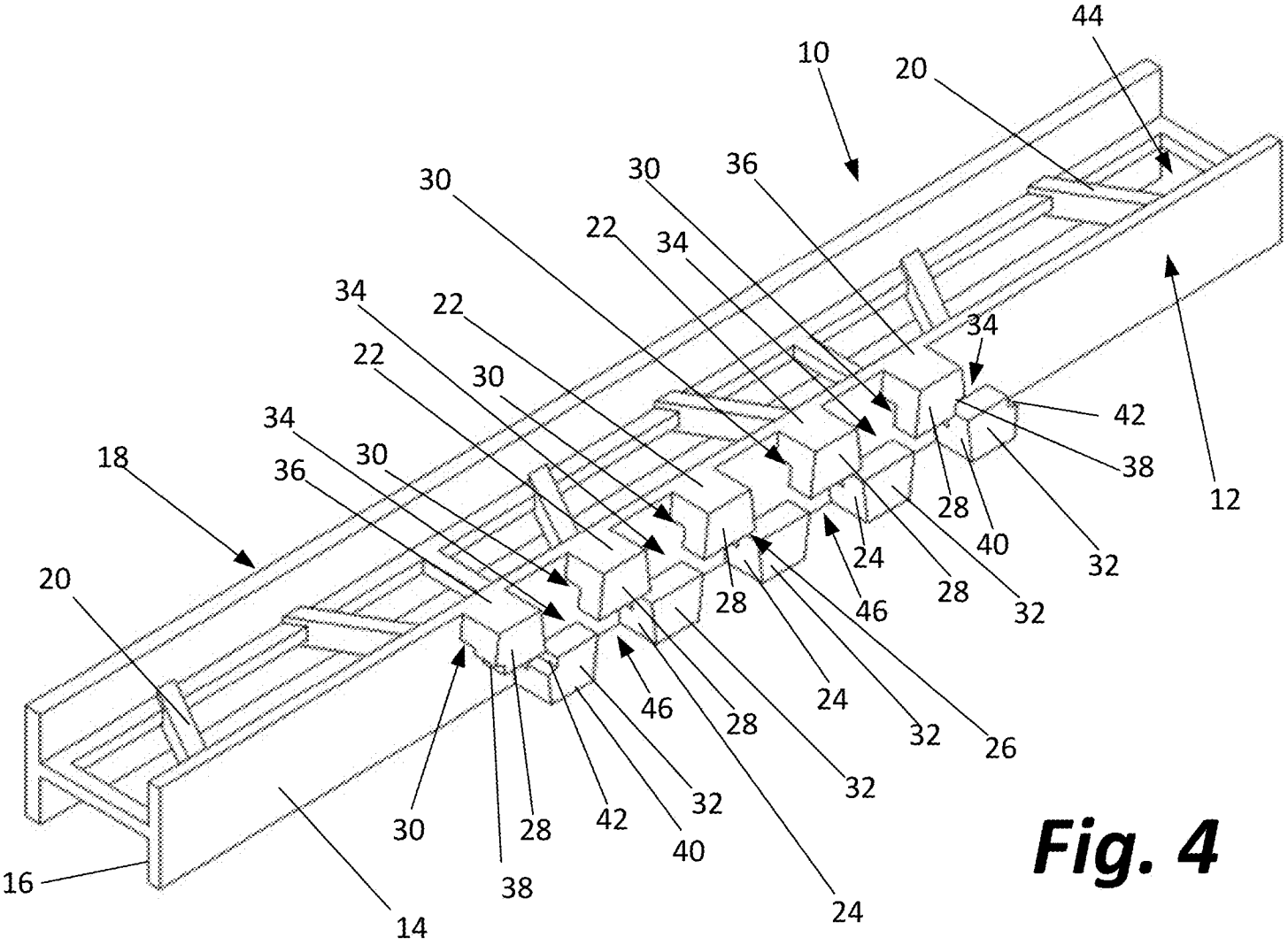
FIG. 4 is perspective view of one of the locking members of FIG. 1.
Figure 5:
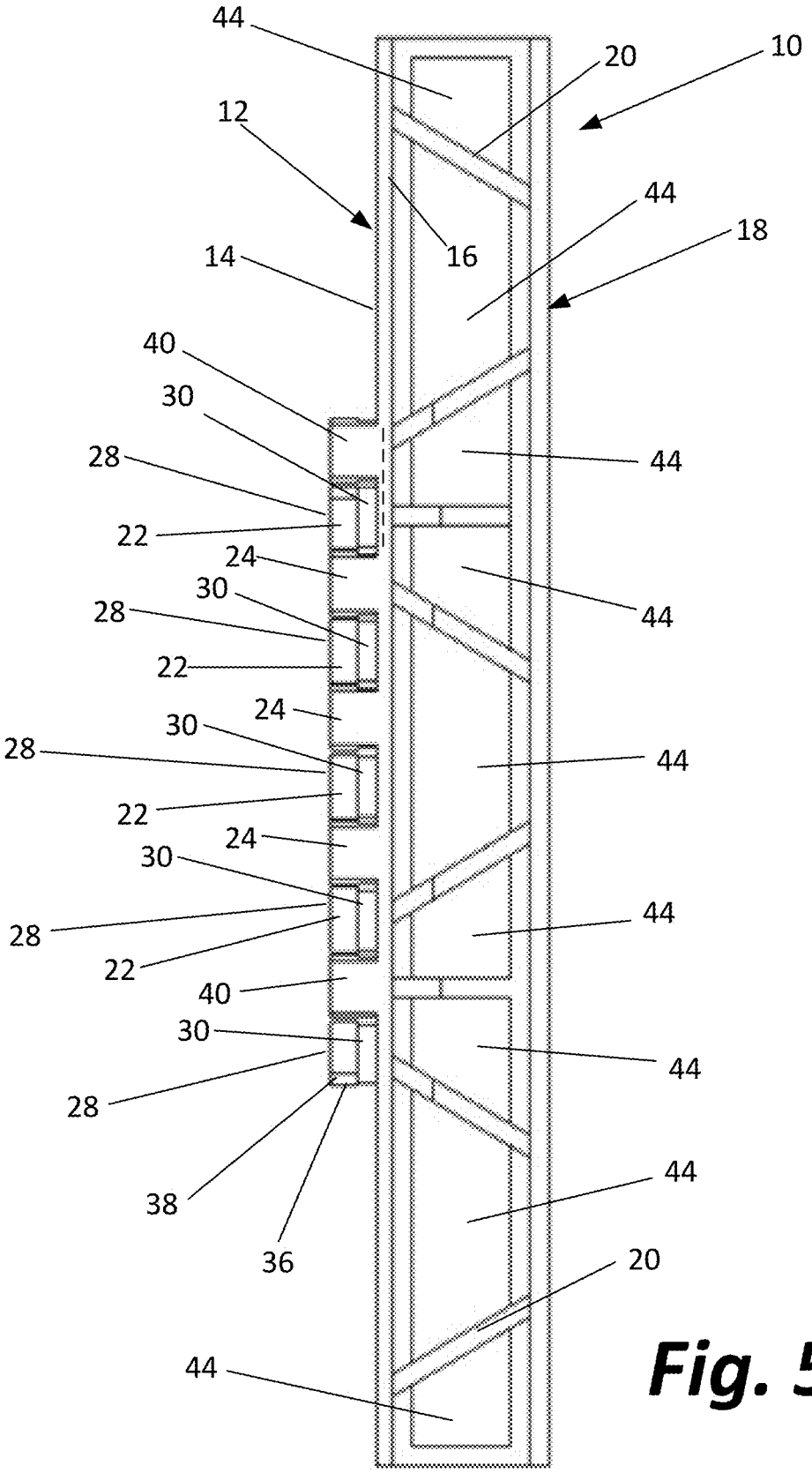
FIG. 5 is a front plan view of the locking member of FIG. 4.
Figure 6:
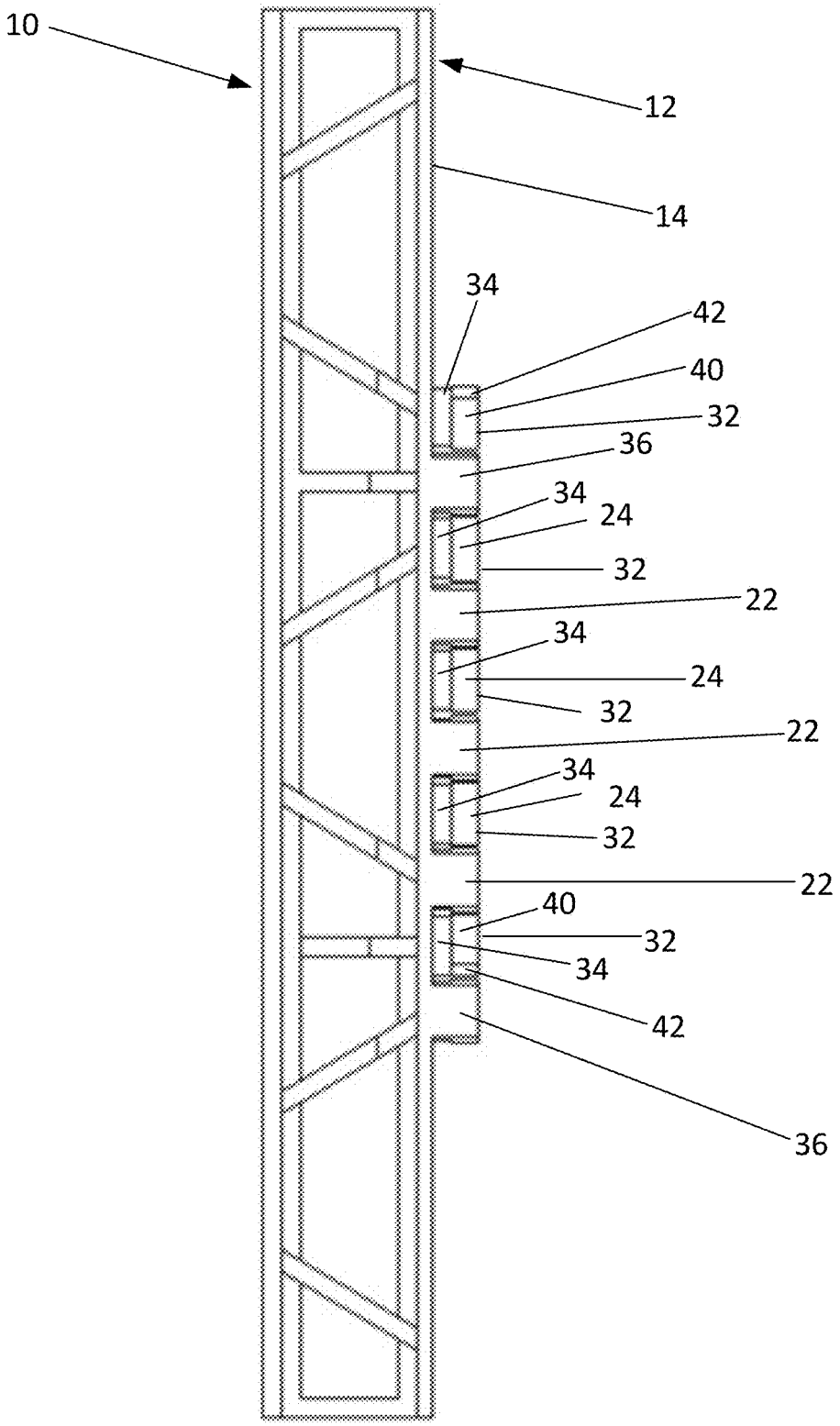
FIG. 6 is rear plan view of the locking member of FIG. 4.
Figure 7:
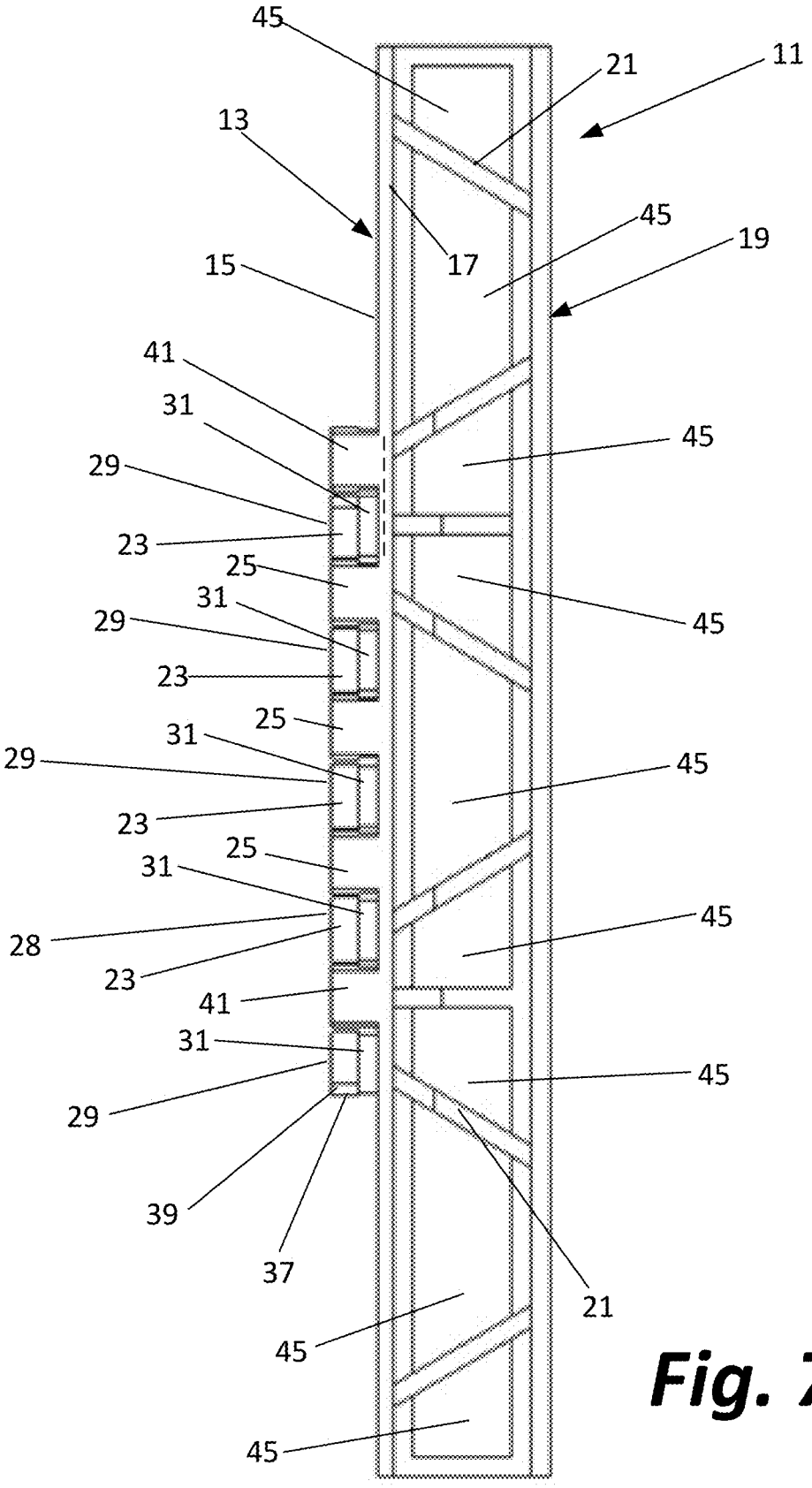
FIG. 7 is front plan view of the other of the locking members of FIG. 1.
Figure 8:
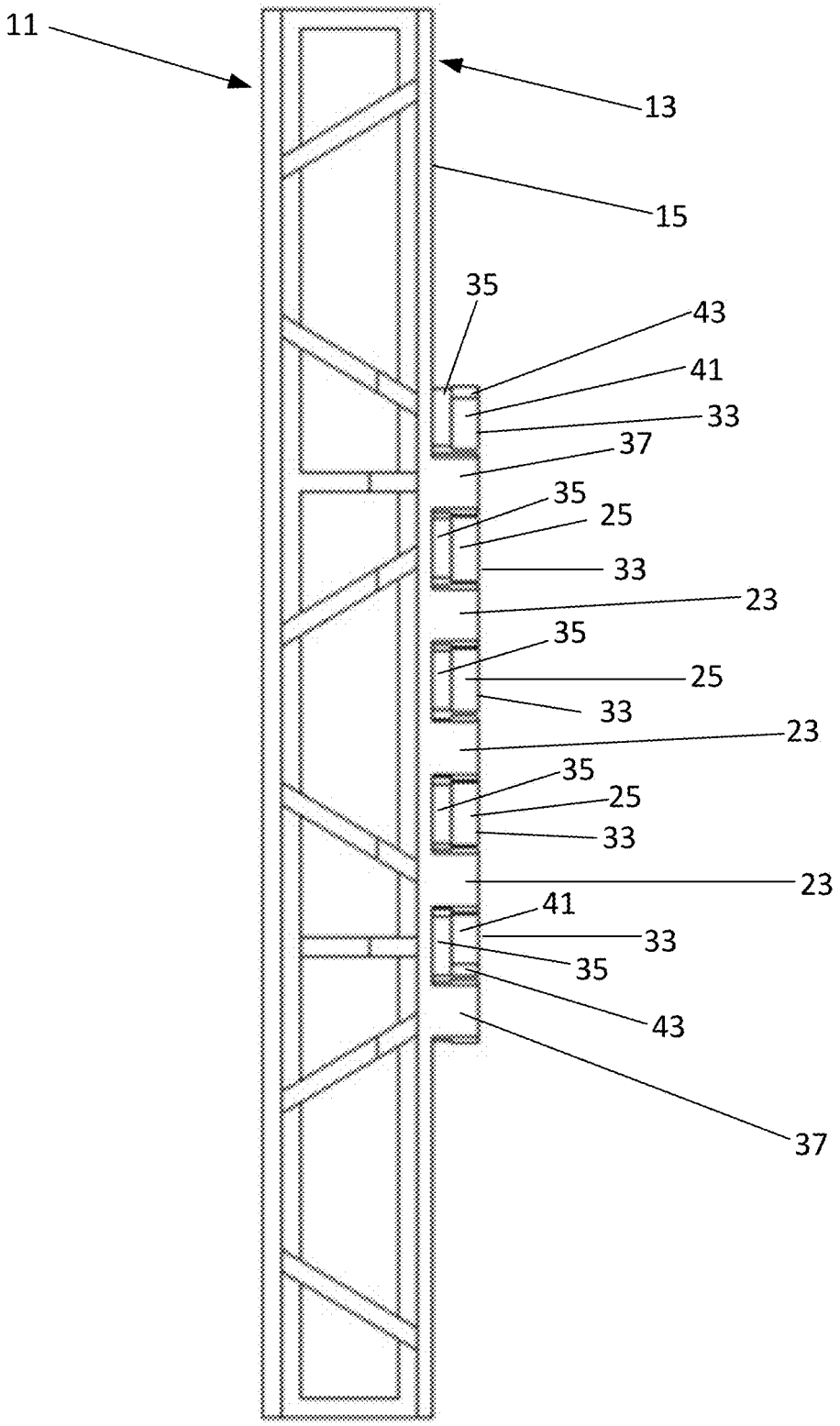
FIG. 8 is a rear plan view of the locking member of FIG. 7.
Figure 9:
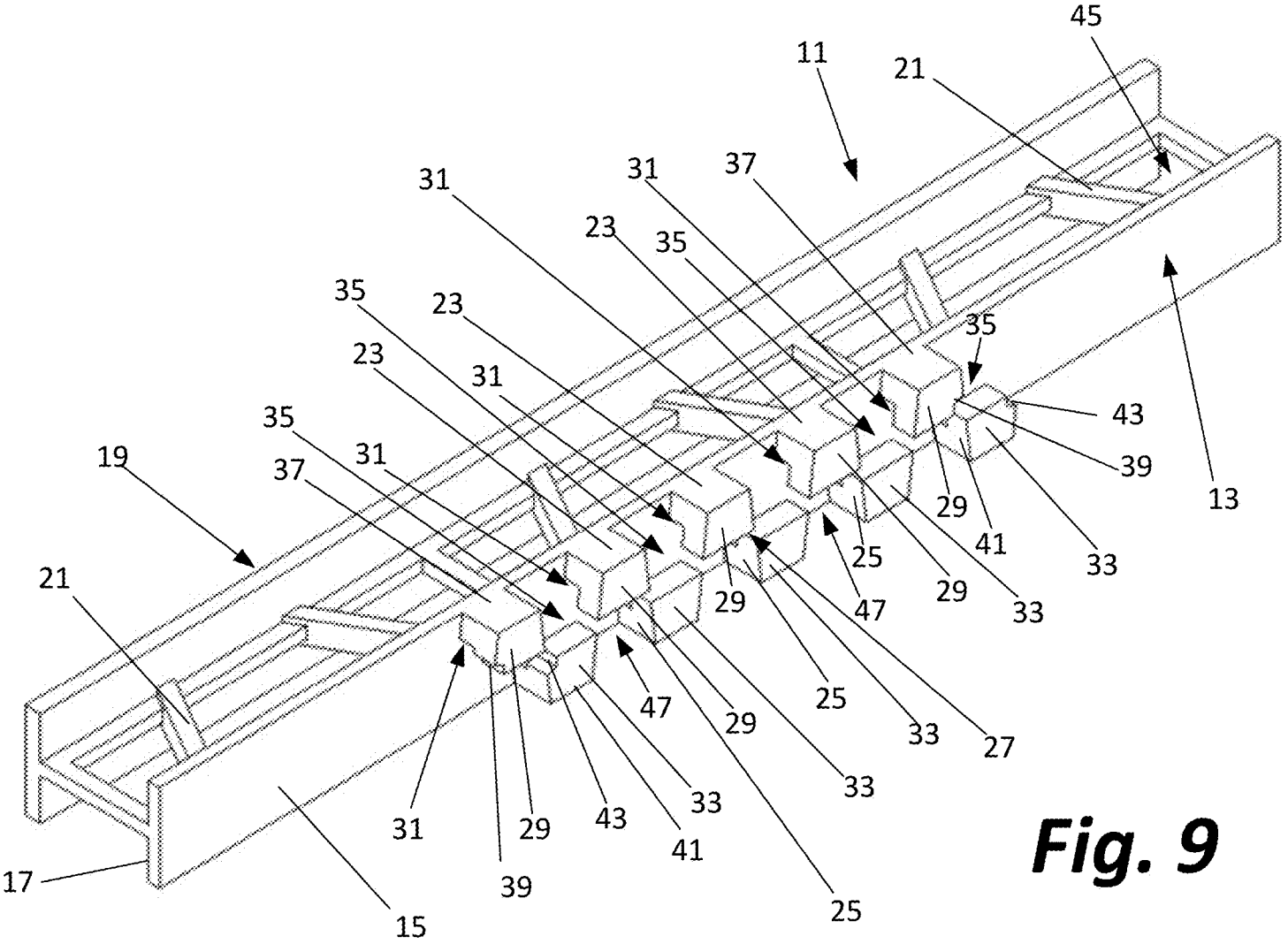
FIG. 9 is a perspective view of the locking member of FIG. 7.
Figure 10:
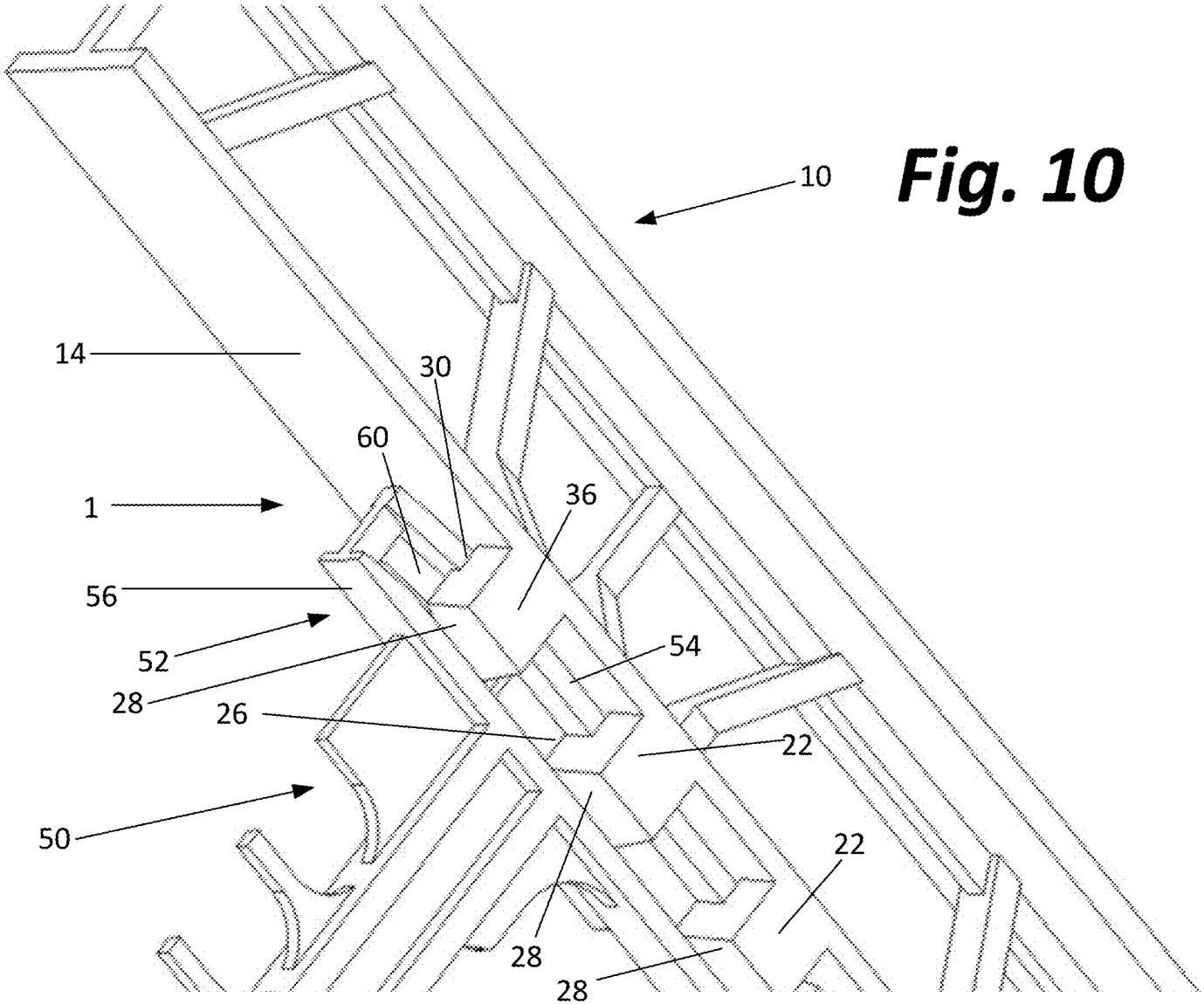
FIG. 10 is a first partial perspective view of the assembly of FIG. 1.
Figure 11:
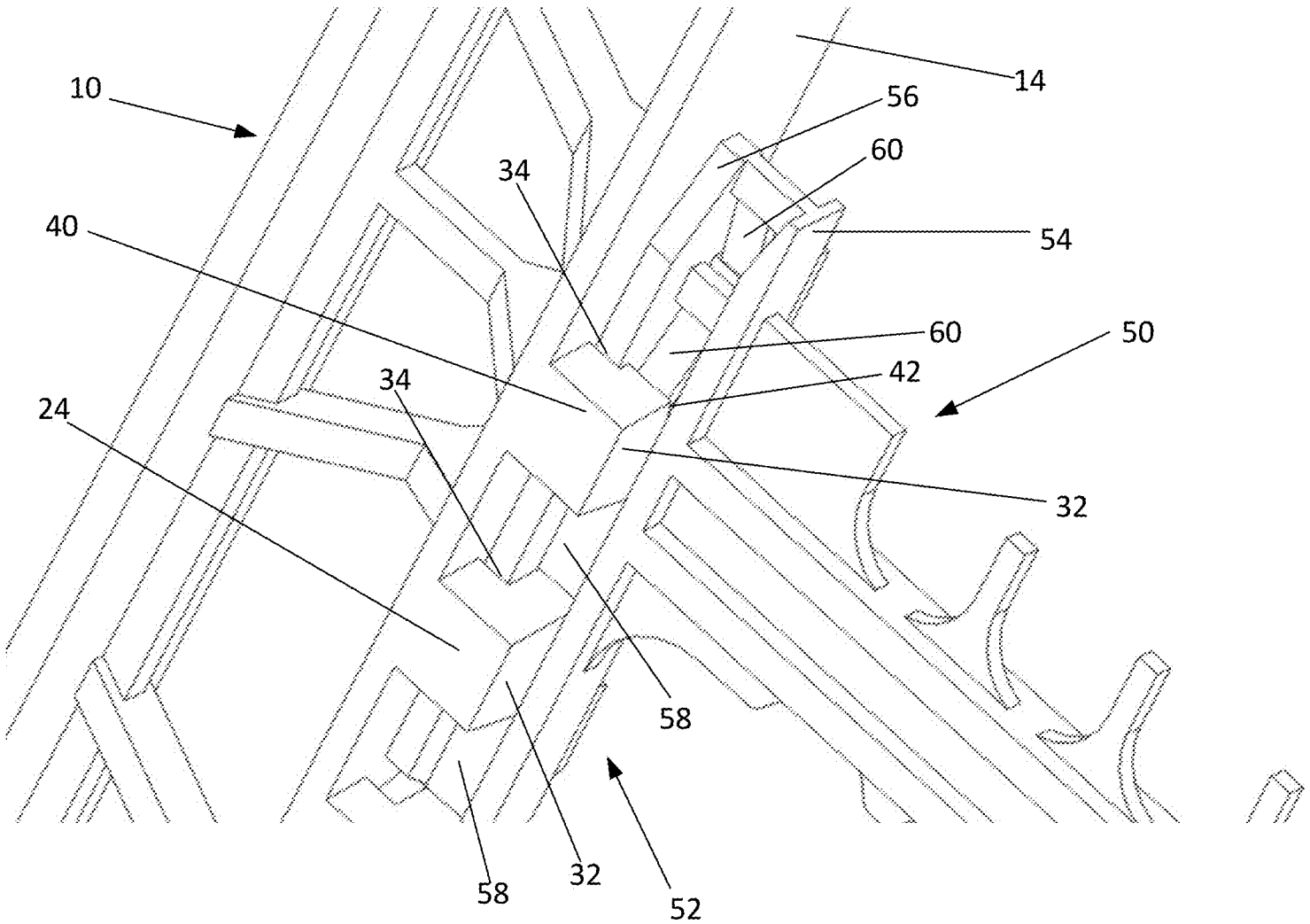
FIG. 11 is a second partial perspective view of the assembly of FIG. 1.

An exemplary tie 50 is best shown in FIGS. 2 and 3. The tie 50 include as first rail 52, a second rail 53, and two bridging members 64 and 66. The bridging members 64 and 66 are fixed to the rails 52 and 53 and hold the rails 52 and 53 parallel to each other a predetermined distance apart. Each rail is shaped like an I-beam. More specifically, the first rail 52 includes an outer rail member 54, and inner rail member 56, and a connecting member 58 joining the outer rail member 54 to the inner rail member 56 and holding these rail members 54 and 56 parallel to each other a fixed distance apart, while the second rail 53 includes an outer rail member 55, and inner rail member 57 and a connecting member 59 joining the outer rail member 55 to the inner rail member 57 and holding these rail members 55 and 57 parallel to each other a fixed distance apart. The first rail 52 may include a score (a narrowed portion) 62 at various places along its length such as at the midpoint as showing in the drawings for reasons to be explained later. Likewise, the second rail 53 may include a score (a narrowed portion) 63 at various places along its length such as at the midpoint.

Locking tabs are provided at each end of each of the rails 52 and 53. Additional locking tabs may be provided adjacent a score in the rail. More specifically, locking tabs 60 are located at each end of rail 52 and locking tabs 61 are located adjacent each end of the rail 53. The tie further includes a pair of bridging members 64 and 66 extending between and holding the rails 52 and 53 parallel to each other and a fixed distance apart. The bridging members 64 and 66 may be provided with concave pathways 65 and 67 for reasons explained below.

Figure 14:
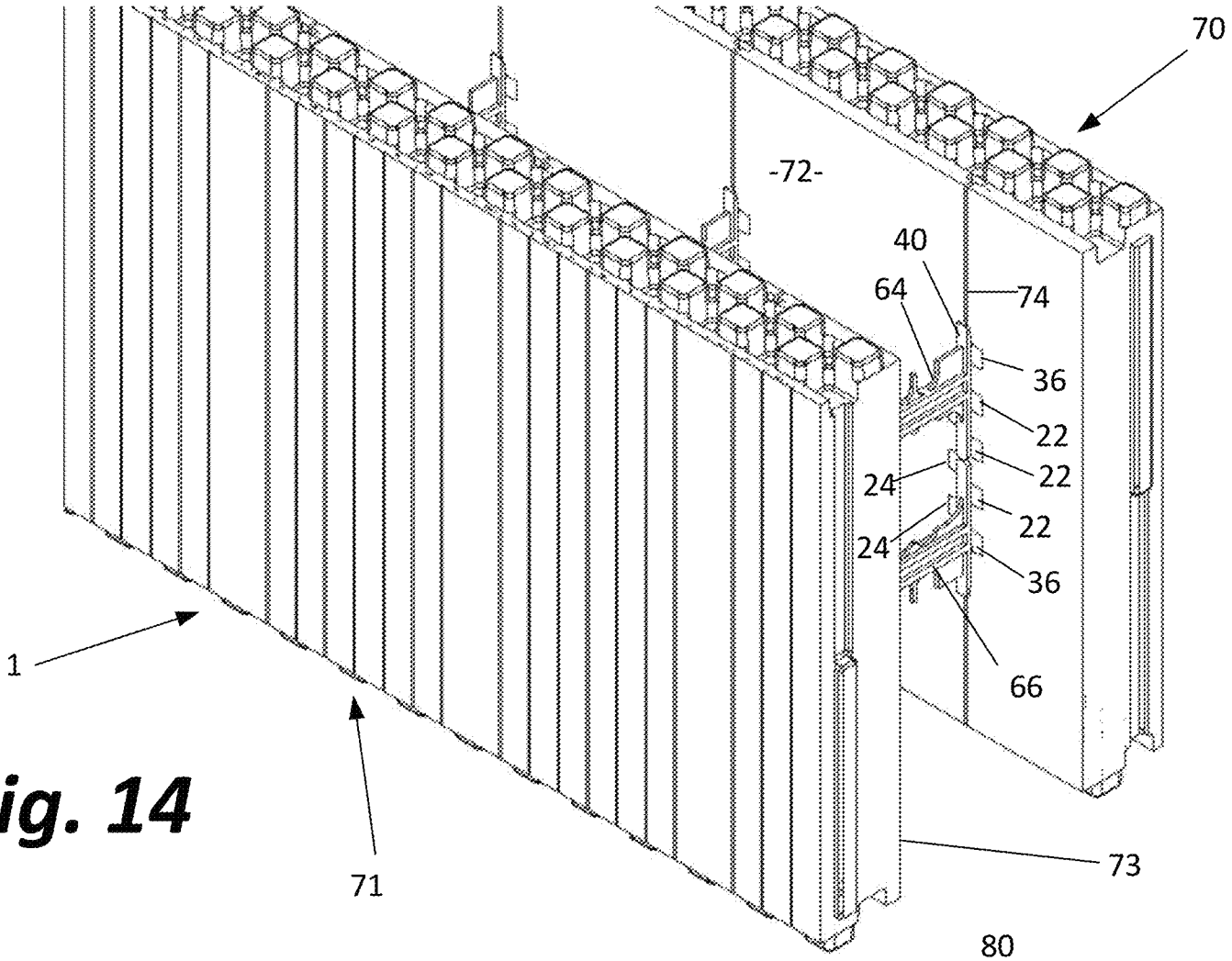
FIG. 14 is a first perspective view of a concrete form assembly made in accordance with the present invention.
Figure 15:
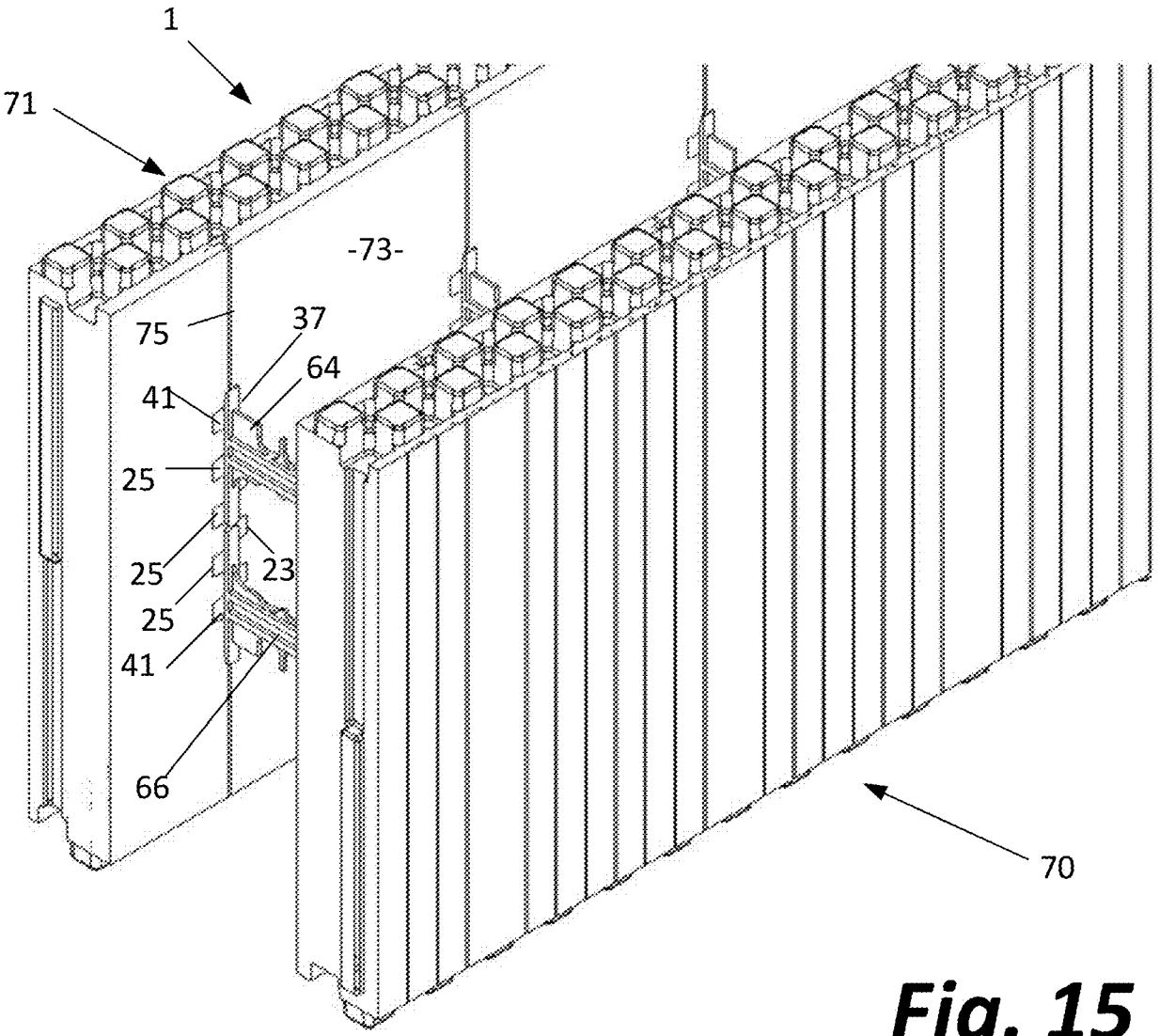
FIG. 15 is a second perspective view of the concrete form assembly of FIG. 14.

The insulated concrete form support assembly 1 described above is intended to be used with a pair of rugged foam insulating panels 70 and 71 to form blocks as shown in FIGS. 14 and 15 which are further assembled to create concrete forms.

The first locking member 10 is imbedded in the foam material as panel 70 is formed, and the second locking member 20 is embedded in the foam material as panel 71 is formed. The foam material flows through the spaces 44/45 defined by the struts 20/21, the inner plate 12/13 and the outer plate 18/19 of the locking members 10/11. The locking member 10 thus becomes fixed in place relative to the panel 70 and the locking member 11 becomes fixed in place relative to the panel 71 as the foam hardens and cures.

Panel 70 has an inside surface 72 defining a plane. Panel 70 also has a channel 74 extending inwardly from this plane to the inside surface 14 of the inner plate 12 of locking member 10. Channel 74 serves to expose the inside surface 14 and the two rows of teeth 22 and 24 of the locking member 10. The inner surfaces 28 of the teeth of the first row of teeth 22 and the inner surfaces 32 of the second row of teeth 24 are co-planar with, or slightly recessed from, the inside surface 72 of the panel 70.

Likewise, panel 71 has an inside surface 73 defining a plane. Panel 70 also has a channel 75 extending inwardly from this plane to the inside surface 15 of the inner plate 13 of the second locking member 11. Channel 75 exposes both the inside surface 13 and the two rows of teeth 23 and 25. The inner surfaces 29 of the teeth of the first row of teeth 23 and the inner surfaces 33 of the second row of teeth 25 of the second locking member 11 are co-planar with, or slightly recessed from, the inside surface 73 of the panel 70.

Such panels 70/71 are easily stacked for storage and transportation. This is because no portion of the locking member 10 extends beyond the inside surface 73 (or any other exterior surface) of the panel 70, and no portion of the locking member 11 extends beyond the inside surface 73 (or any other exterior surface) of the panel 71. This is also because the ties 50 may easily be joined to the locking members 10 and 11 in the field.

Two such panels 70/71 can be joined together to form a block to be used in constructing a concrete form by mating a tie 50 to the locking members 10 and 11 embedded in the panels 70/71. There are several ways to do so.

A first way is to begin by aligning the panels 70/71 on a rigid flat surface, so the two locking members 10/11 extend vertically and face each other. It makes no difference which end of either locking member 10 or 11 is up or down or which of the panels 70 and 71 is to the right or left.

Next, the rails 52 and 53 of tie 50 are positioned above the two locking members 10 and 11. It makes no difference which rail is positioned above which locking member or which end of the tie is up or down. Thus, while the foregoing discussion assumes that rail 52 is positioned above locking member 10 and rail 53 is positioned above rail locking member 11, the opposite could be the case.

More specifically, connecting member 58 is aligned with gap 26 and connecting member 59 is aligned with gap 27. Further, the outer rail member 54 is aligned with the channels formed by the recesses/cavities 30 and 34 in the teeth of the first row of teeth 22 and the second row of teeth 24 of locking member 10, and the outer rail member 55 is aligned with the channels formed by the recesses/cavities 31 and 35 in the teeth of the first row of teeth 23 and the second row of teeth 25 of locking member 11.

When the first locking member 10, second locking member 11 and the tie 50 are so aligned, the tie 50 can then be slid downwardly and into a locked position. In the locked position, the first rail 52 is coupled to the first locking member 10 because: (a) outer rail member 54 resides in the recesses 30 of the teeth of the first row of teeth 22 and in the recesses 34 of the second row of teeth 24, (b) the connecting member 58 is in the gap 26, (c) the inner rail member 56 is in face-to-face registration with the inner surfaces 28 of the first row of teeth 22 and the inner surfaces 32 of the second row of teeth 24, and (d) and the locking tabs 60 are in engagement with the notches 38 in the end teeth 36 of the first row of teeth 22 and notches 42 in the end teeth 40 of the second row of teeth 24. In the locked position, the second rail 53 is coupled to second locking member 11 because: (a)outer rail member 55 resides in the recesses 31 of the teeth of the first row of teeth 23 and in the recesses 35 of the second row of teeth 25, (b) the connecting member 58 is in the gap 27, (c) the inner rail member 57 is in face-to-face registration with the inner surfaces 29 of the first row of teeth 23 and the inner surfaces 33 of the second row of teeth 25, and (d) the locking tabs 61 are in engagement with the notches 39 in the end teeth 37 of the first row of teeth 23 and notches 43 in the end teeth 41 of the second row of teeth 25.

Of course, the embodiment of the present invention described above also permits the tie 50 to be joined to the locking member embedded in one of the panels, and separately and subsequently joined to the locking member embedded in a second of the panels. Likewise, in certain situations it may be beneficial to join the locking members to the ties and then form the panels about the locking members.

In some situations, a form of a different size may be required, such as to provide spaces in the concrete wall for doors or windows of a building. While this may be accommodated by using panels, locking members and ties of different lengths, in some instances is desirable to cut the panels to size in the field. To facilitate this, the locking members 10 and 11 and rails 52 and 53 may be provided with a score, i.e., a reduced thickness at one or more points (such as the midpoint) along their length. See, e.g., scores 62 and 63. When the rails 52 and 53 of the tie 50 are scored, bridging member 64 is positioned on one side of the score and bridging member 66 is positioned on the other side of the score. Also, the desired thickness of the concrete may change. To facilitate this, ties 50 having bridging members 64 and 66 of different lengths may be provided to vary the distance between the inside surfaces 72 and 73 of the panels 70 and 71 to provide the desired predetermined distance 80 between the inside surfaces 72 and 73 of the panels 70 and 71.

Also, it is quite common to reinforce concrete with rebar. To facilitate placement and retention of rebar in the proper orientation within the form, the bridging members 64 and 66 are provided with concave pathways 65/67 adapted to allow sections of rebar to be supported by the bridging members 64/66 at various positions along the length of the bridging members 64/66.

This invention has been described herein in considerable detail to comply with the patent statutes and to provide those skilled in the art with the information needed to apply the novel principles and to construct and use embodiments of the example as required.

However, it is to be understood that the invention can be carried out by specifically different devices and that various modifications can be accomplished without departing from the scope of the invention itself.

What is claimed is:

1. A concrete form assembly comprising:

a. first locking member having an inner plate, an outer plate, a plurality of struts extending between the inner plate and the outer plate and holding the inner plate and outer plate in spaced relation relative to each other, a plurality of teeth projecting from a first surface of the inner plate and arranged in two rows each having opposing ends and separated from each other by a space, each of said plurality of teeth having a recess open toward the space and an inside surface; and b. a tie comprising a first rail having a first rail member, a second rail member, a connecting member, and locking tabs, wherein the rail is adapted to permit the connecting member to slide through the space while the first rail member slides through and is captured by the recesses of the teeth and the second rail member slides across the inside surfaces of the teeth, wherein said locking tabs are adapted to engage the opposing ends of the two rows, and wherein teeth at opposing ends of the two rows have notches adapted to be engaged by the locking tabs.

2. The concrete form assembly of claim 1 wherein said first locking member is adapted to be embedded within a first insulative panel having a first inside panel surface defining a first plane.

3. The concrete form assembly of claim 2 wherein the inside surfaces of the teeth are exposed.

4. The concrete form assembly of claim 2 wherein the first surface of the inner plate is exposed, and the inside surfaces of the teeth are also exposed and co-planer with the inside panel surface.

5. The concrete form assembly of claim 1 wherein the tie further comprises a second rail identical to the first rail, and at least one bridging member extending between the first rail and the second rail holding the first rail and second rail a predetermined distance apart.

6. The concrete form assembly of claim 5 further comprising a second locking member identical to the first locking member.

7. The concrete form assembly of claim 1 further comprising a second locking member identical to the first locking member, and wherein the tie further comprises a second rail identical to the first rail, and at least one bridging member extending between the first rail and the second rail holding the first rail and second rail a predetermined distance apart.

8. The concrete form assembly of claim 7 wherein the second locking member is adapted to be embedded within a second insulative panel having a second inside panel surface defining a second plane.

9. The concrete form assembly of claim 8 wherein the concrete form assembly is adapted to hold the first inside panel surface and the second inside panel surface a predetermined distance apart.

10. The concrete form assembly of claim 1 wherein the first and second locking members and tie are each formed as a single molded piece from a plastic material.

11. A concrete form assembly comprising:

a. first and second locking members, each of said first and second locking members having: (i) an inner plate, (ii) an outer plate, (iii) a plurality of struts extending between the inner plate and the outer plate and holding the inner plate and outer plate in spaced relation relative to each other, (iv) a plurality of teeth projecting from a first surface of the inner plate and arranged in two rows each having opposing ends and separated from each other by a space, each of said plurality of teeth having a recess open toward the space and an inside surface; and b. a tie comprising first and second rails connected and held in spaced, parallel relation to each other by at least one bridging member, each of said first and second rails having: (i) a first rail member, (ii) a second rail member, (iii) a connecting member, and (iv) locking tabs at opposing ends of the rail, wherein the tie is adapted to be coupled to the first locking member by aligning the first rail with the first locking member, sliding the connecting member of the first rail through the space of the first locking member while sliding the first rail member of the first rail through the recesses of the teeth of the first locking member and the second rail member of the first rail across the inside surfaces of the teeth of the first locking member until the locking tabs of the first rail engage the opposing ends of the rows of teeth of the first locking member, and wherein teeth at opposing ends of the two rows have notches adapted to be engaged by the locking tabs.

12. The concrete form assembly of claim 11 wherein said tie is adapted to be coupled to the second locking member by aligning the second rail with the second locking member, sliding the connecting member of the second rail through the space of the second locking member while sliding the first rail member of the second rail through the recesses of the teeth of the second locking member and the second rail member of the second rail across the inside surfaces of the teeth of the second locking member until the locking tabs of the second rail engage the opposing ends of the rows of teeth of the second locking member.

13. The concrete form assembly of claim 11 wherein said first locking member is adapted to be embedded within a first insulative panel having a first panel surface defining a first plane and said second locking member is adapted to be embedded within a second insulative panel having a second panel surface defining a second plane, wherein the inner surfaces of the teeth of the first locking member are exposed without projecting from the first insulative panel past the first panel surface, and wherein the inner surfaces of the teeth of the second locking member are exposed without projecting from the second insulative panel past the second panel surface.

14. The concrete form assembly of claim 13 wherein the concrete form assembly is adapted to hold the first inside panel surface and the second inside panel surface a predetermined distance apart.

15. The concrete form assembly of claim 11 wherein the first locking member and the second locking member are interchangeable.

16. The concrete form assembly of claim 11 wherein the first locking member and the second locking member are reversable vertically.

17. The concrete form assembly of claim 11 wherein the tie is reversable both horizontally and vertically.

18. A concrete form assembly comprising:

a. a first locking member having an inner plate, an outer plate, a plurality of struts extending between the inner plate and the outer plate and holding the inner plate and outer plate in spaced relation relative to each other, a plurality of teeth projecting from a first surface of the inner plate and arranged in two rows each having opposing ends and separated from each other by a space, each of said plurality of teeth having a recess open toward the space and an inside surface; and b. a tie comprising a first rail having a first rail member, a second rail member, a connecting member, and locking tabs, wherein the rail is adapted to permit the connecting member to slide through the space while the first rail member slides through and is captured by the recesses of the teeth and the second rail member slides across the inside surfaces of the teeth, wherein said locking tabs are adapted to engage the opposing ends of the two rows, wherein the tie includes two bridging members extending between the rails in spaced apart relation and the rails are scored between the two bridging members.

* * * * *